US005492040A

United States Patent [19]

Bellas

[11] Patent Number: 5,492,040

[45] Date of Patent: Feb. 20, 1996

[54] DUAL WRENCH AND METHOD THEREFOR

[76] Inventor: Roy S. Bellas, P.O. Box 401, Ridgebury Rd., New Hampton, N.Y. 10958

[21] Appl. No.: 257,930

[22] Filed: Jun. 10, 1994

[51] Int. Cl.[6] ..... B25B 13/02

[52] U.S. Cl. ..... 81/125.1; 81/177.2; 81/124.4

[58] Field of Search ..... 81/125.1, 124.3–124.7, 81/177.1, 177.2, 489, 177.85

[56] References Cited

U.S. PATENT DOCUMENTS

| | | | |
|---|---|---|---|
| 2,110,202 | 3/1938 | Crane | 81/177.2 X |
| 2,466,884 | 4/1949 | English et al. | 81/125.1 |
| 2,564,812 | 8/1951 | McGuire | 81/177.1 X |
| 4,939,960 | 7/1990 | Kinzli | 81/124.4 |
| 5,086,674 | 2/1992 | Her | 81/124.4 |

FOREIGN PATENT DOCUMENTS

| | | | |
|---|---|---|---|
| 608661 | 7/1926 | France | 81/124.4 |

*Primary Examiner*—D. S. Meislin

*Attorney, Agent, or Firm*—Harry M. Weiss; Jeffrey D. Moy; Harry M. Weiss & Associates

[57] ABSTRACT

A first wrench and a second wrench each has a threaded hole in the handle thereof. A connection fixture which has a threaded rod that has a central portion fixedly connected within a nut is screwed into the wrenches, whereby the wrenches are removeably connected.

3 Claims, 2 Drawing Sheets

DUAL WRENCH AND METHOD THEREFOR

BACKGROUND OF THE INVENTION

1. Field of Invention

This invention relates to hand tools and methods therefor and, more particularly, to wrenches and a method therefor.

2. Description of the Prior Art

When a manufacturer decides to make a change from metric sized fittings to British sized fittings or vice versa, a worker is often faced with the task of determining whether a bolt, for example, is a metric or a British sized fitting. After making the determination, the worker must find the correct wrench for the fitting. The time expended in making the determination and for finding the correct wrench substantially increases assembly time for a machine, such as an automobile, where there are a multiplicity of fittings.

It should be understood that the difference between corresponding metric and British sized fittings is small, but significant. In the United States, bolts for a power steering unit of an automobile, for example, must be tightened in accordance with federal guidelines that necessitate the usage of the correct wrench.

In one portion of the prior art, exemplified by U.S. Pat. No. 995,876, a wrench is disclosed with a rotatable jaw head that has a plurality of jaws. When the jaw head is rotated to position a selected jaw for use on a fitting of a work piece, the handle of the wrench maintains the jaw head against rotation. It should be understood that the choice of jaw sizes is on the order of four or five.

Similarly, U.S. Pat. No. 1,168,204 discloses a wrench with two revolvable wrench heads mounted on respective ends of a handle. A wrench head is maintained against rotation by a locking dog connected to the handle. Each of the wrench heads provides a choice of four or five jaw sizes. Because the wrench heads are mounted on the ends of the handle, a person may find that one of the wrench heads provides an obstacle to gripping the handle.

U.S. Pat. No. 216,690 discloses a handle having a ratchet head on one end and three jaws at the other end. The three jaws each have a shoulder that makes one jaw suitable for use on two sizes of fittings.

U.S. Pat. No. 1,404,881 discloses a tappet wrench set that includes a plurality of wrenches, each with an integrally connected wrench head at opposite ends of a handle. The jaws of one of the wrench heads is oriented with its centerline at right angles to the centerline of the handle. However, each wrench of the set has only two jaws.

U.S. Pat. No. 1,808,190 discloses a plurality of wrenches that are constructed for convenient storage.

U.S. Pat. No. 4,574,665 discloses a ratchet type wrench wherein two sets of cusps make it suitable for use on metric and a similarly British sized fitting.

It should be understood that whenever a plurality of tools are used to work with different sized fittings of a work piece, there usually is a loss of time as the worker puts aside one tool and looks for another tool. Heretofore, there has not been a suitable way of minimizing the loss of time without using wrenches that are complex and expensive.

SUMMARY OF THE INVENTION

An object of the present invention is to provide a wrench that is suitable for working with fittings of a work piece that differ in size and method therefore.

Another object of the present invention is to provide a dual wrench that is suitable for working with two fittings of a work piece that differ in size. The dual wrench may be disassembled to form a wrench with a palm sized grip that is useable within a work space of a reduced size.

BRIEF DESCRIPTION OF THE EMBODIMENTS

According to the present invention, a first wrench and a second wrench are removeably connected to each other.

A wrench in accordance with the present invention is suitable for use on two different fittings of a preselected size and type.

Other features and advantages of the invention may be apparent from the following description of embodiments thereof as illustrated in the accompanying drawing.

DESCRIPTION OF THE EMBODIMENTS

Figure 1:
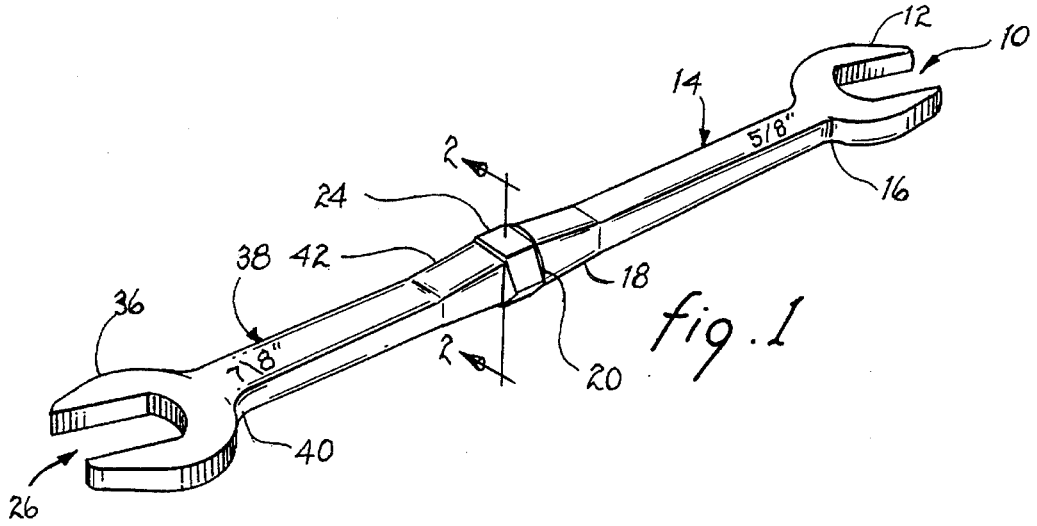
FIG. 1 is a perspective view of a first embodiment of the present invention.
Figure 2:
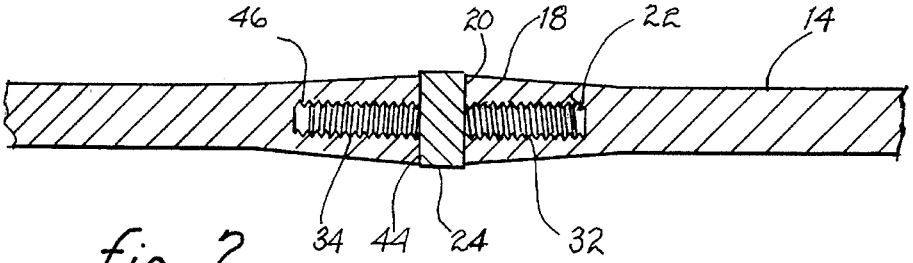
FIG. 2 is a view of FIG. 1 taken along the line 2—2.
Figure 3:
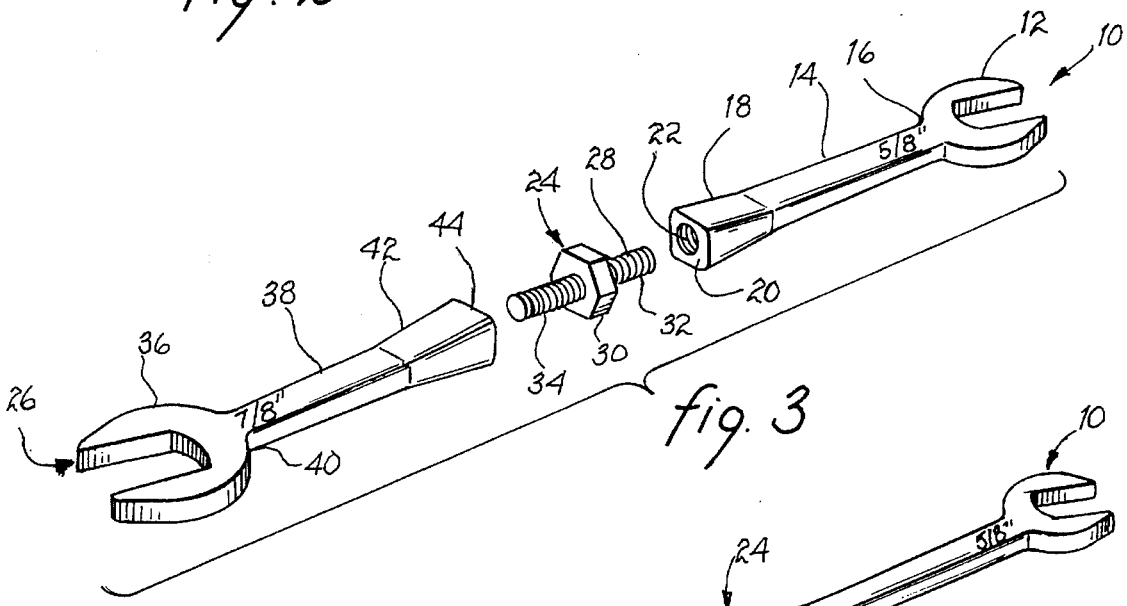
FIG. 3 is an exploded perspective view of the embodiment of FIG. 1.

As shown in FIGS. 1–3, a ⅝ inch open end wrench 10 has a head 12 integrally connected to a shank 14 at a proximal end 16 thereof. Shank 14 has a substantially rectangular cross section between proximal end 16 and a section 18 of shank 14. Open end wrenches are well known to those skilled in the art.

Section 18 is flared to cause a distal end 20 of shank 14 to have a rectangular cross section of increased dimensions. A threaded hole 22 extends perpendicularly from substantially the center of end 20 into section 18. It should be understood that shank 14 is a handle of wrench 10. As explained hereinafter, a connection fixture 24 is used to connect wrench 10 to a ⅞ inch open end wrench 26 to form a dual wrench.

Fixture 24 includes a threaded rod 28 that has a central portion fixedly connected within a nut 30, whereby rod 26 and nut 30 are coaxially connected. Nut 30 divides rod 28 into a threaded connection sections 32, 34. Section 32 is screwed into hole 22 (FIGS. 1 and 3).

Wrench 26, referred to hereinbefore, has a head 36 integrally connected to a shank 38 at a proximal end 40 thereof. Similar to shank 14, shank 38 has the rectangular cross section between proximal end 40 and a section 42 of shank 38.

Section 42 is flared to cause a distal end 44 of shank 38 to have the rectangular cross section of increased dimensions. A threaded hole 46 (FIG. 2) extends perpendicularly from substantially the center of end 44 into section 42. Section 42 and hole 46 are similar to section 18 and hole 22, respectively. It should be understood that shank 38 is a handle of wrench 26.

In this embodiment, section 34 is screwed into hole 46, whereby wrenches 10, 26 are removeably connected to each other. When wrenches 10, 26 are connected, they form a dual wrench that is suitable for working with either 5/8 inch or 7/8 inch fittings.

It should be understood that where there is insufficient room to manipulate the dual wrench, wrench 10 may be disconnected from wrench 26, whereby wrenches 10, 26 are useable as individual wrenches each having a palm sized grip. In an alternative embodiment, either wrench 10 or wrench 26 is connected to a wrench that is suitable for working with a metric sized fitting.

The present invention is especially suitable for providing a set of dual wrenches where each dual wrench includes wrenches respectively suitable for working with corresponding metric and British sized fittings. In other words, the invention may be used to provide a set of wrenches for metric sized fittings and a set of wrenches for British sized fittings within a space within a toolbox where a single set of wrenches had been stored. A tabulation of corresponding metric and British sized fittings that are in common industrial usage is given as:

| British Fitting (inches) | Metric fitting (millimeters) |
|---|---|
| 1/8 | 4 |
| 5/32 | 4.5 |
| 3/16 | 5 |
| 7/32 | 5.5 |
| 1/4 | 6 |
| 9/32 | 7 |
| 5/16 | 8 |
| 11/32 | 9 |
| 3/8 | 10 |
| 7/16 | 11 |
| 1/2 | 13 |
| 9/16 | 14 |
| 19/32 | 15 |
| 5/8 | 16 |
| 21/32 | 17 |
| 11/16 | 18 |
| 3/4 | 19 |
| 5/32 | 20 |
| 13/16 | 21 |
| 7/8 | 22 |
| 15/16 | 24 |

Figure 4:
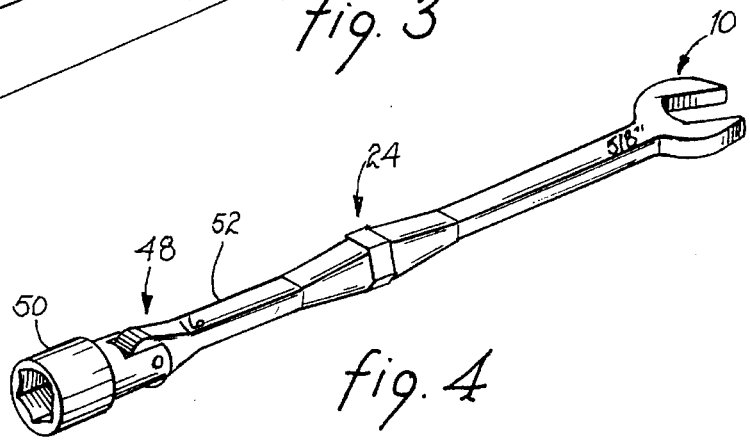
FIG. 4 is a perspective view of a second embodiment of the present invention.

As shown in FIG. 4, in a second embodiment of the present invention, a socket wrench 48 has a head 50 that is connected to a shank 52 that is similar to shanks 14, 38. Fitting 24 is used to removeably connect wrench 10 to wrench 48 in a manner similar to the connection of wrenches 10, 26. Socket wrenches are well known to those skilled in the art.

Figure 5:
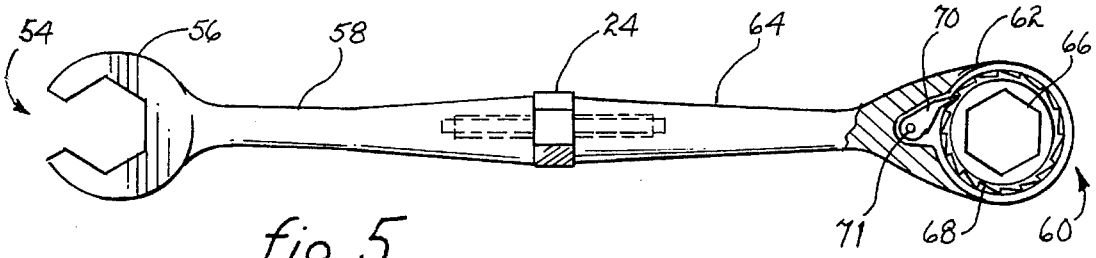
FIG. 5 is a plan view, with parts broken away, of a third embodiment of the present invention.

As shown in FIG. 5, in a third embodiment of the present invention, a flare wrench 54 has a head 56 that is connected to a shank 58 that is similar to shanks 14, 38. Flare wrenches are well known to those skilled in the art.

A box ratchet wrench 60 has a head 62 that is connected to a shank 64 that is similar to shanks 14, 38. Head 62 includes a hexagonal collar 66 within a circular ratchet 68. Additionally, a pawl 70 is pivotally mounted on a pin 71 in a position that causes pawl 70 and ratchet 68 to form a well known type of pawl and ratchet arrangement. Fitting 24 is used to removeably connect wrenches 54, 60 in a manner similar to the connection of wrenches 10, 26. Box ratchet wrenches are well known to those skilled in the art.

Figure 6:
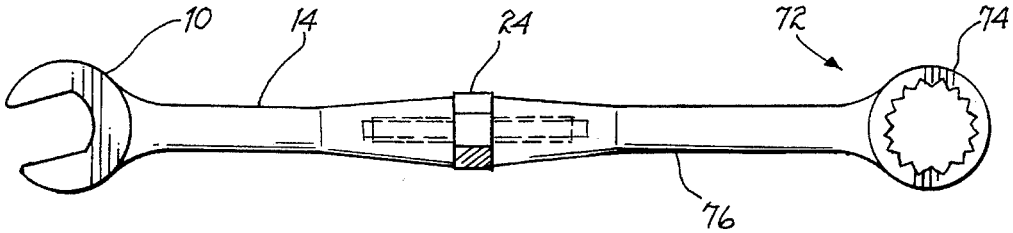
FIG. 6 is a plan view of a fourth embodiment of the present invention.

As shown in FIG. 6, in a fourth embodiment of the present invention, a box wrench 72 has a head 74 that is connected to a shank 76 that is similar to shanks 14, 38. Fitting 24 is used to removeably connect wrench 10 to wrench 72 in a manner similar to the connection of wrenches 10, 26. Box wrenches are well known to those skilled in the art.

Figure 7:
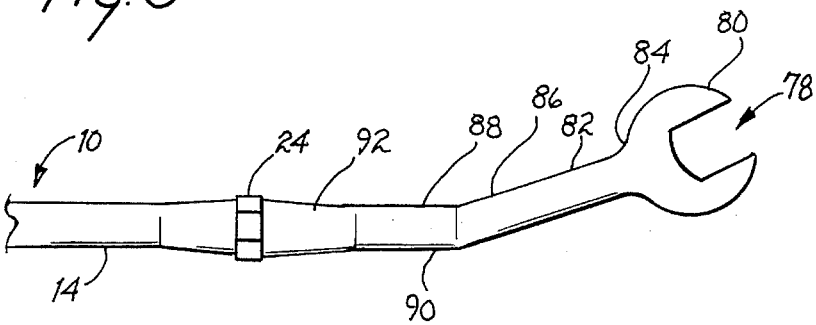
FIG. 7 is a plan view, with parts broken away, of a fifth embodiment of the present invention.

As shown in FIG. 7, in a fifth embodiment of the present invention, an open end wrench 78 has a head 80 integrally connected to a shank 82 at a proximal end 84 thereof. Shank 82 has the substantially rectangular cross section.

A distal end 86 of shank 82 is integrally connected to an offset member 88 at an obtuse angle, whereby shank 82 and member 88 form an offset handle. Offset member 88 has the substantially rectangular cross section between a proximal end 90 thereof and a section 92 which is similar to section 18. Fitting 24 is used to removeably connect wrench 10 to wrench 78 in a manner similar to the connection of wrenches 10, 26.

While the invention has been particularly shown and described with reference to a preferred embodiment thereof, it should be understood by those skilled in the art that changes in form and detail may be made therein without departing from the spirit and scope of the invention. It should be emphasized that the new, dual wrench may combine two separate wrenches together in one of at least three manners, namely, combining a British sized wrench and a metric sized wrench, combining a British sized wrench and another British sized wrench, or combining a metric sized wrench and another metric sized wrench. Please understand that for each of the aforementioned wrench combinations, different sized wrench head fittings may be used, and, in addition, different types of wrench head fittings may be used such as the socket, flare, box, open end, ratchet, and the offset wrench. Additionally, note that these wrenches may be implemented in either the dual wrench mode or in the separate, palm sized wrench mode. The palm size mode is simply using the dual wrench with one of the two wrenches removed therefrom. Those skilled in the art will recognize that wrenches which are different in size and/or type may be integrated with the novel, dual wrench arrangement disclosed herein.

I claim:

1. A dual wrench, comprising:

first and second wrenches, including wrench handles; and means for removably connecting the ends of said handles of said wrenches together, each of said handles of said first and second wrenches having a tapered outwardly flared end portion and a threaded hole extending therein substantially from the center of the end of each handle; said means comprising a threaded rod and a nut with said rod passing therethrough, said nut having a height dimension substantially equal to corresponding height dimensions of each of said tapered outwardly flared end portions of each handle to provide both an enlarged gripping portion and a substantially continuous dual wrench, said nut being fixedly connected to a central portion of said rod.

2. The dual wrench of claim 1 wherein said first wrench has an offset handle.

3. The dual wrench of claim 1 wherein said first and second wrenches are suitable for working with each combination of a metric sized fitting and a British sized fitting, a metric sized fitting and another metric sized fitting, and a British sized fitting and another British sized fitting, respectively, where a tabulation of corresponding metric and British sized fittings is given as:

| British Fitting (inches) | Metric fitting (millimeters) |
|---|---|
| 1/8 | 4 |
| 5/32 | 4.5 |
| 3/16 | 5 |
| 7/32 | 5.5 |
| 1/4 | 6 |
| 9/32 | 7 |
| 5/16 | 8 |
| 11/32 | 9 |
| 3/8 | 10 |
| 7/16 | 11 |
| 1/2 | 13 |
| 9/16 | 14 |
| 19/32 | 15 |

-continued

| British Fitting (inches) | Metric fitting (millimeters) |
|---|---|
| 5/8 | 16 |
| 21/32 | 17 |
| 11/16 | 18 |
| 3/4 | 19 |
| 5/32 | 20 |
| 13/16 | 21 |
| 7/8 | 22 |
| 15/16 | 24. |

* * * * *